US006286856B1

(12) United States Patent
Rocca

(10) Patent No.: US 6,286,856 B1
(45) Date of Patent: Sep. 11, 2001

(54) ELASTIC RETURN DEVICE FOR SKI BINDING

(75) Inventor: Daniel Rocca, Chanoz-Chatenay (FR)

(73) Assignee: Look Fixations S.A., Nevers (FR)

( * ) Notice: Subject to any disclaimer, the term of this patent is extended or adjusted under 35 U.S.C. 154(b) by 0 days.

(21) Appl. No.: 09/088,202

(22) Filed: Jun. 1, 1998

(30) Foreign Application Priority Data

Jun. 6, 1997 (FR) ..... 97-07262

(51) Int. Cl.[7] ..... A63C 9/08

(52) U.S. Cl. ..... 280/634; 280/629; 280/624; 280/632; 280/625

(58) Field of Search ..... 280/634, 632, 280/625, 626; 267/69, 629, 624

(56) References Cited

FOREIGN PATENT DOCUMENTS

| | | |
|---|---|---|
| 407261 | 1/1991 | (EP) . |
| 2 610 842 | 8/1988 | (FR) . |
| WO 92 08527 | 5/1992 | (WO) . |

*Primary Examiner*—Michael Mar
*Assistant Examiner*—Hau Phan
(74) *Attorney, Agent, or Firm*—Bugnion S.A.; John Moetteli

(57) ABSTRACT

An elastic return device for a safety ski binding comprising a coil spring (10) and having a stiffness which varies as a function of the stress rate. A deformable plastic (11) is interposed between the turns of the spring, so that the stiffness of the spring increases with the rate at which it is compressed.

This elastic element makes it possible to avoid premature release of the binding.

11 Claims, 2 Drawing Sheets

ELASTIC RETURN DEVICE FOR SKI BINDING

FIELD OF THE INVENTION

The invention relates to an elastic return device for a safety ski binding comprising a coil spring with a stiffness which varies as a function of the stress rate, in which the springs works in compression.

PRIOR ART

Patents FR 1 454 511, DE 24 15 957, DE 26 34 649, FR 2 424 040, FR 2 625 687 and FR 2 661 334 disclose bindings in which a damper is associated with a spring with a view to preventing premature release due to impacts or the like. This damper makes it possible to vary the force with which the binding resists opening as a function of the stress rate, the release force being high for violent stresses, but relatively low for gentle stresses. This makes it possible to adapt the response of the front binding better to the mechanical strength characteristics of a skier's leg, which can withstand a stress which is intense but brief, but risks being breaking in the case of a stress which is relatively weak but is exerted for a relatively long period of time.

The damper is mounted in series with the spring in the bindings described in patents FR 1 454 511 and DE 26 34 649. In the binding according to patent FR 2 642 657, the damper is mounted coaxially inside the spring. The use of devices of this type, in a front binding which has two jaws that are articulated and act on a rod passing through the spring, would require very extensive modification to the binding.

A similar device is disclosed by patent FR 2 642 657.

Patents FR 2 424 040, 2 625 687 and 2 661 334 propose mounting the damper parallel to the spring. This arrangement makes it possible to leave the interior of the spring free for the rod, but increases the volume of the body of the binding and, in any case, also requires significant modification to the binding.

Patent application DE 24 15 957 further proposes mounting a spring between the two pistons of a hydraulic damper, inside the cylinder.

Further, in all the known designs, the damper is of the hydraulic piston type, of the type described in patent FR 1 454 511, that is to say consisting of a cylinder and a piston which displaces a liquid in this cylinder through a nozzle. It is therefore still a conventional damper device which can be detached from the spring and works in parallel or in series with the spring.

International patent application WO 92/08527 proposes arranging a piece of viscous material as a dynamic damping means between the tip of a rear binding piston and the jaw of this binding.

SUMMARY OF THE INVENTION

As a radical departure from those embodiments which involve a hydraulic damper, the object of the present invention is to produce a variable-stiffness device which is simple, compact, robust and can be mounted in a front or rear binding without modification to this binding.

The elastic return device according to the invention is one which comprises a deformable plastic interposed between the turns of the spring, so that the stiffness of the spring increases with the rate at which it is compressed.

The plastic may constitute a helical line between the turns of the spring, or be present as a tubular cylinder in whose thickness the spring is embedded. In both cases, the interior of the elastic return device remains free for a rod to pass through it, so that the return device can be mounted in a rod-type front binding without modification to the binding, as a replacement for the usual spring.

The deformable plastic may also constitute a solid cylinder, at least in its central part, the spring being embedded in the peripheral region of this cylinder. A return device of this type can be mounted in a rear binding without modification thereto. The central part of the cylinder essentially constitutes a mechanical support for the spring and the plastic located between the turns of the spring, and as an optional accessory, an auxiliary central damper.

BRIEF DESCRIPTION OF THE DRAWINGS

The appended drawing represents, by way of example, two embodiments of the return device according to the invention.

DESCRIPTION OF THE PREFERRED EMBODIMENTS

Figure 1:
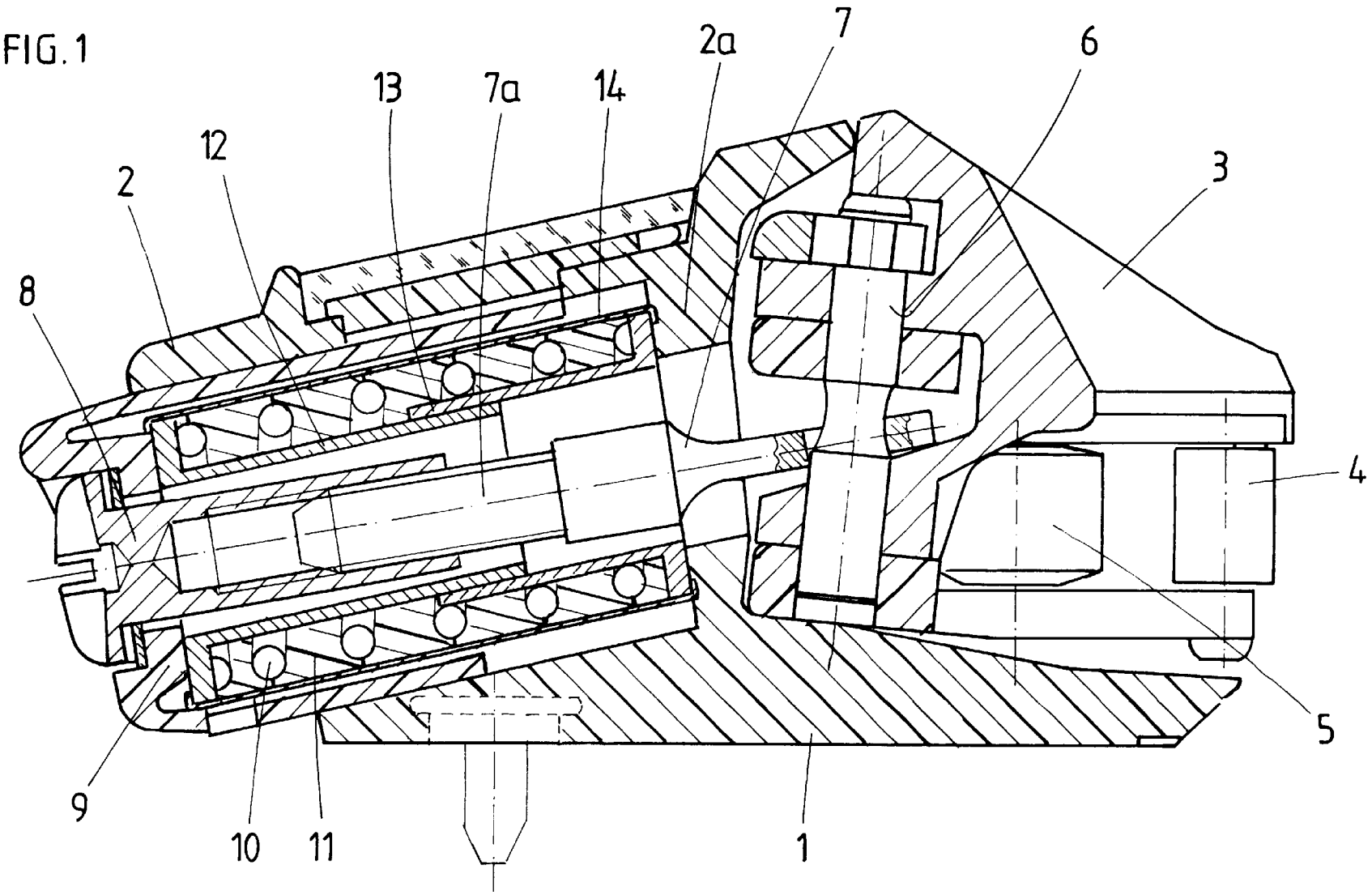
FIG. 1 is a view in axial section of a vertical plane of a front binding or co-piece.

The front binding or co-piece represented in FIG. 1 is similar to the binding described in patent EP 0 295 372, to which reference may be made for further details. This binding has a base 1 secured to a binding body 2 on which a jaw is mounted. This jaw consists of two arms, the arm 3 of which can be seen in FIG. 1, which are mounted so as to pivot independently of one another about two separate vertical axes constituted by rounded vertical edges of the body 2 which are arranged symmetrically on either side of the vertical plane of symmetry corresponding to the section plane, as described in patent EP 0 295 372, so that they can move away from one another and bear against the end of the boot via rollers 4 and 5. These arms constitute levers of the first class that are articulated on a slightly oblique central axis 6 passing through the end of a rod 7, a threaded part 7*a* of which is screwed into a tubular nut 8 bearing on a stop 9 in the form of a bush. An elastic return device, consisting of a spring 10 working in compression between the mobile stop 9 and a bearing face 2*a* of the body 2, is mounted inside this stop. A line 11 of deformable plastic, the stiffness and damping of which vary as a function of the stress rate, is wound helically between the turns of the spring 10. The radial support to the line 11 is provided, internally, by a telescopic tube in two parts 12 and 13, and, externally, by a covering 14 made of elastic material, for example rubber, or a heat-shrinkable sheath, the ends of which are folded over the ends of the telescopic tube.

The telescopic tube 12/13 and the covering 14 preferably constitute a leaktight compartment.

The material 11 is preferably a material belonging to the family of silicon rubbers EPDMs, commonly known in the art by this acronym (see, for example, http://buffalophargo.com/html/epdm.htm1#Hyptable) or PDMSs (polydimethylsiloxanes), or the like, optionally filled with organic or inorganic fillers such as fumed silica, talc, colloidal silica. These fillers make it possible to impart thixotropic properties to the material, that is to say to modify its viscosity in order to obtain a more or less pasty or gelatinous state. A material of this type is deformable and as a stiffness which varies as a function of the stress rate, in particular the compression rate. In compression, the spring 10 coated in this way therefore behaves as a variable-stiffness spring.

The variable-siffness spring is in the form of a tubular element which can straightforwardly be fitted in place of the usual spring in a binding of the type described in patent EP 0 295 372.

The deformable plastic could also be in the form of a sleeve, in whose thickness the spring 10 would be embedded.

The deformable plastic could be present over only a part of the length of the spring.

Figure 2:
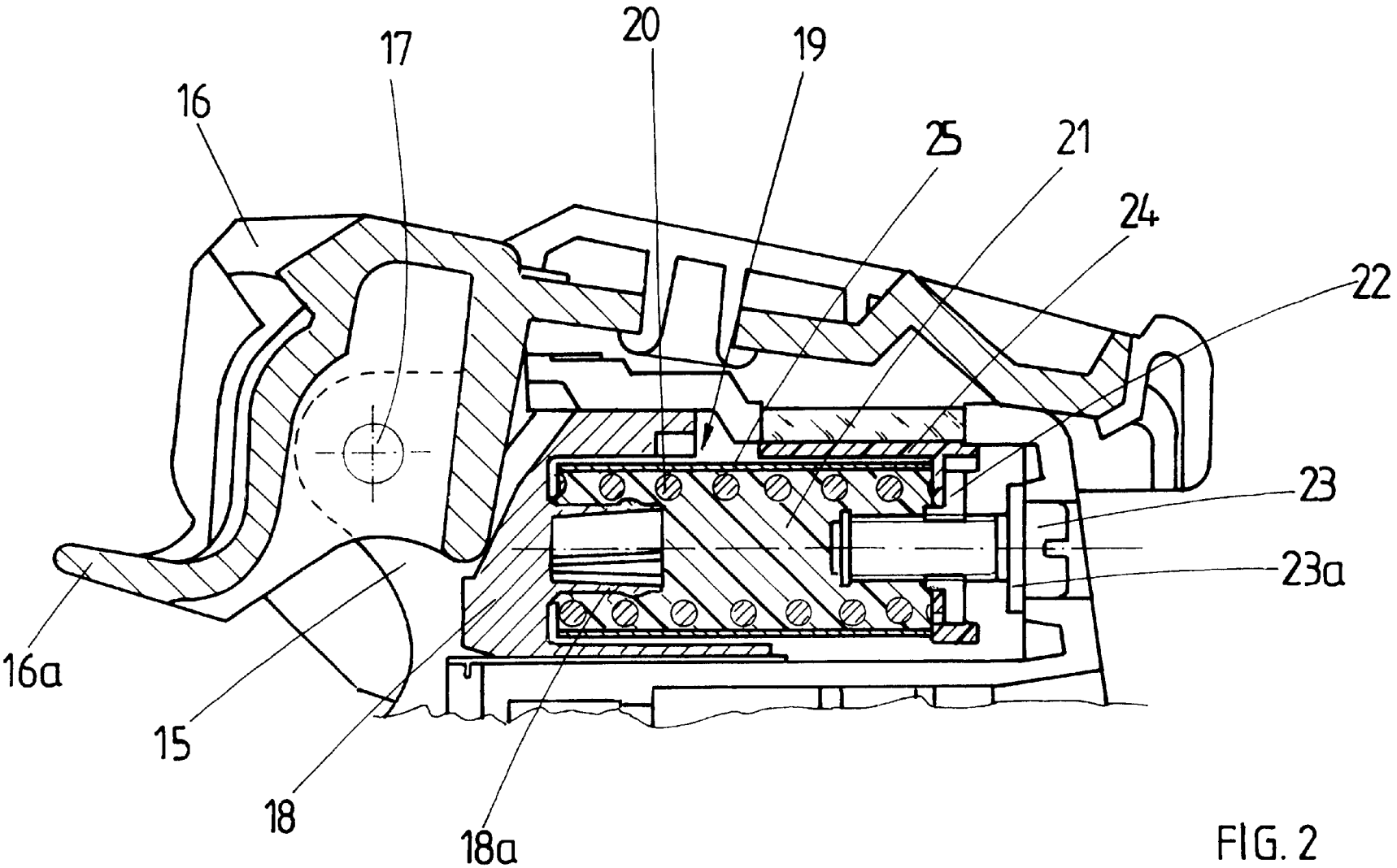
FIG. 2 is a view in axial section of a vertical plane of a rear binding or heel piece.

In known fashion, the rear binding or heel piece represented in FIG. 2 has a binding body 15 mounted so as to slide on a rail (not shown). A jaw 16 is articulated on this body 15 about an axis 17, this jaw being intended to bear on the heel of the boot and having a pedal-shaped lower part 16*a* for engaging the boot by pressing it on this pedal. When the boot is being engaged, the jaw 16 pushes a piston 18 back against the action of an elastic device 19 consisting of a spring 20 embedded in the peripheral part of a cylindrical body 21 of deformable plastic whose stiffness varies as a function of the stress rate. This material 21 is of the same type as the material 11. The elastic return device 19 is fitted between the piston 18 and a nut 22 which is itself mounted on a screw 23 provided with a collar 23*a* by which it bears on the binding body 15. The nut 22 displaces a cursor 24 for displaying the setting at which the device 19 is precompressed by means of the screw 23. In its ends, the body 21 has two axial cylindrical holes, one for engaging a tubular central part 18 of the piston, which part secures the piston 18 to the device 19 for fitting, the other axial hole allowing passage for the screw 23. The body 21 is also provided with an elastic covering 25.

Like the front binding, the device 19 contains a spring, between the turns of which the deformable plastic is interposed. The central region of the body 21 serves essentially to support the part of the deformable material located in the spring. As an accessory, this central region may also have a damping effect. However, in the design which is represented, this effect is negligible in view of the very small section by which the hollow part 18*a* of the piston 18 bears on the body 21.

It should be noted that the device 19 could be produced in a telescopic tubular form, as in the case of the front binding which has been represented.

As for the front binding, the deformable material could be present, between the turns of the spring, only over a part of the length of the spring.

What is claimed is:

1. An elastic return device for use in a safety ski binding, comprising a coil spring (10; 20) having a plurality of turns with a stiffness which varies as a function of a stress rate imposed upon the coil spring, in which the coil spring is under compression between a pair of telescoping members, a helical insert member (11, 21) made of deformable plastic material and having turns which are interposed between the turns of the coil spring, so that the stiffness of the elastic return device increases with the rate at which stresses acting upon a ski boot fixed in the safety ski binding causes the elastic return device to compress, wherein the coil spring and the helical insert member are surrounded by an elastic, leaktight covering (14) installed in the form of an elastic sheath over the coil spring and the helical insert member and joined to the telescoping members.

2. The device as claimed in claim 1, wherein the deformable plastic is a silicon rubber.

3. The device as claimed in claim 1, wherein the deformable plastic is an EPDM.

4. The device as claimed in claim 1, wherein the deformable plastic is a polydimethylsiloxanes.

5. The device as claimed in claim 1, wherein the deformable plastic is filled with an inorganic or organic material.

6. The device as claimed in claim 5, wherein the inorganic filler consists of fumed silica or talc or colloidal silica.

7. The device as claimed in claim 1, wherein the deformable plastic constitutes a helical insert member between the turns of the spring (10).

8. The device as claimed in claim 1, wherein the deformable plastic forms a tubular cylinder in whose thickness the spring is embedded.

9. The device as claimed in claim 1, wherein a telescopic tube (12, 13) and the elastic covering (14) form a leaktight compartment.

10. The device as claimed in claim 1, wherein the deformable plastic forms a solid cylinder (21) at least in its central part.

11. The device as claimed in claim 1, wherein the deformable elastic material is present between the turns of the spring only over a part of the length of the spring.

* * * * *